US005098258A

United States Patent [19]

Barnetche-Gonzalez

[11] Patent Number: 5,098,258

[45] Date of Patent: Mar. 24, 1992

[54] MULTIPLE STAGE DRAG TURBINE DOWNHOLE MOTOR

[76] Inventor: Eduardo Barnetche-Gonzalez, Rio Grijalva No. 11, Col. Vista Hermosa, Cuernavaca, Moselos, Mexico

[21] Appl. No.: 645,763

[22] Filed: Jan. 25, 1991

[51] Int. Cl.[5] ..... F01D 25/00; F03B 13/00

[52] U.S. Cl. ..... 415/182.1; 415/901; 415/903; 415/55.2; 415/75; 416/177; 175/107

[58] Field of Search ..... 415/901, 903, 71, 72, 415/73, 74, 55.1-55.7; 416/176, 177; 175/107

[56] References Cited

U.S. PATENT DOCUMENTS

| | | | |
|---|---|---|---|
| 466,751 | 1/1892 | Gardner . | |
| 1,581,465 | 4/1926 | Morton | 415/901 |
| 2,724,338 | 11/1955 | Roth | 415/55.2 |
| 3,404,924 | 10/1968 | Choate . | |
| 3,405,912 | 10/1968 | Lari et al. . | |
| 3,594,106 | 7/1971 | Garrison | 415/903 |
| 3,728,040 | 4/1973 | Ioanesian et al. . | |
| 3,876,350 | 4/1975 | Warder | 175/107 |
| 3,966,369 | 6/1976 | Garrison | 175/107 |
| 3,971,450 | 7/1976 | Fox | 415/903 |
| 4,146,353 | 3/1979 | Carrouset . | |
| 4,225,000 | 9/1980 | Maurer . | |
| 4,415,316 | 11/1983 | Jurgens . | |
| 4,427,079 | 1/1984 | Walter | 175/107 |
| 4,500,253 | 2/1985 | Haberl | 415/55.2 |
| 4,773,489 | 9/1988 | Makohl . | |

FOREIGN PATENT DOCUMENTS

| | | |
|---|---|---|
| 662734 | 7/1938 | Fed. Rep. of Germany . |
| 1159988 | 7/1958 | France . |
| 272885 | 3/1930 | Italy . |
| 11563 | of 1899 | United Kingdom . |
| 781860 | 8/1957 | United Kingdom . |

OTHER PUBLICATIONS

"Hydraulic Downhole Drilling Motors Turbodrills and Positive Displacement Rotary Motors", Tiraspolsky, edited by Gulf Publishing Co., 1985.

*Primary Examiner*—Edward K. Look
*Assistant Examiner*—Michael S. Lee
*Attorney, Agent, or Firm*—Armstrong, Nikaido, Marmelstein, Kubovcik & Murray

[57] ABSTRACT

A multistage drag turbine assembly is provided for use in a downhole motor, the drag turbine assembly comprising an outer sleeve and a central shaft positioned within the outer sleeve, the central shaft having a hollow center and a divider means extending longitudinally in the hollow center for forming first and second longitudinal channels therein. A stator is mounted on the shaft. The stator has a hub surrounding the shaft and a seal member fixed to the hub, wherein the hub and the shaft each have first and second slot openings therein. A rotor comprising a rotor rim and a plurality of turbine blades mounted on the rotor rim is positioned within the outer sleeve for rotation therewith with respect to the stator such that a flow channel is formed in the outer sleeve between the turbine blades and the stator. A flow path is formed in the turbine assembly such that fluid flows through the turbine assembly flows through the first longitudinal channel in the central shaft, through the first slot openings in the shaft and the stator hub, through the flow channel wherein the fluid contacts the edges of the turbine blades for causing a drag force thereon, and then through the second slot openings in the stator hub and the shaft into the second channel.

7 Claims, 11 Drawing Sheets

MULTIPLE STAGE DRAG TURBINE DOWNHOLE MOTOR

BACKGROUND OF THE INVENTION

1. Field of the Invention

The present invention is directed to a multiple stage turbine for use as a downhole motor on a drilling string, and more particularly, to a multiple stage turbine downhole motor which is driven by the drag or shear stress force of the fluid flowing through the turbine acting on the edges of the turbine blades.

2. Description of the Prior Art

Prior art downhole motors for use on drilling strings convert the kinetic energy of a mass of a fluid against the face surface of turbine blades into power for turning a drill string and thereby a drill bit attached to the bottom of the drill string. The turbines rely solely on the dynamic or impulse force of the fluid against the face surface of the turbine blade. Prior art downhole motors of this type are generally required to be relatively long in order to have sufficient turbine blade surface area for generating enough power to turn the bit at the proper speed with sufficient torque. However, because the downhole motor itself is quite long, it is difficult for the drill string to move through curves and thus it is much more difficult to control the direction of drilling.

Another disadvantage of the dynamic force type downhole motors, is that maximum power and efficiency occur at rather high rotational speeds; higher than the range of operational speed for most mechanical drill bits, like tricone bits. The reason for this characteristic is that the functions of power and efficiency, in terms of the velocity of the flow is proportional to the square of the velocity. The function is a parabola in which the apex is approximately midway between zero and runaway or no load speed.

Still another disadvantage of prior art downhole turbine motors is that the turbine blades are internal with respect to the drilling shaft. In order to drive the turbine, fluid must flow through the internal structure of the drill string and can cause damage to the bearings, seals and other internal parts of the downhole motor.

SUMMARY OF THE INVENTION

It is the primary object of the present invention to provide a multiple stage turbine which operates by using the shear force of the fluid on the edges of the blades of the turbine.

It is another object of the present invention to provide a downhole motor for use in turning a drill string, and thereby a drill bit on the end of the drill string, which operates at a relatively slow speed of 300–500 rpm and produces high torque, with no torque on the pipe of the drill string itself.

It is another object of the present invention to provide a multiple stage turbine in which the rotor having the turbine blades, is external to the central shaft of the drill string and thus the moving parts are external to the central shaft. Further, because the blades are attached to an external movable part, the generated forces are farther away from the axis of the turbine, giving more leverage and hence more torque.

The present invention is directed to a multistage drag turbine assembly for use in a downhole motor, the drag turbine assembly comprising an outer sleeve and a central shaft positioned within the outer sleeve, the central shaft having a hollow center and a divider means extending longitudinally in the hollow center for forming first and second longitudinal channels therein. A stator is mounted on the shaft. The stator has a hub surrounding the shaft and a seal member fixed to the hub, wherein the hub and the shaft each have first and second slot openings therein. A rotor comprising a rotor rim and a plurality of turbine blades mounted on the rotor rim is positioned within the outer sleeve for rotation therewith with respect to the stator such that a flow channel is formed in the outer sleeve between the turbine blades and the stator. A flow path is formed in the turbine assembly such that fluid flowing through the turbine assembly flows through the first longitudinal channel in the central shaft, through the first slot openings in the shaft and the stator hub, through the flow channel wherein the fluid contacts the edges of the turbine blades for causing a drag force thereon, and then through the second slot openings in the stator hub and the shaft into the second channel.

DETAILED DESCRIPTION OF THE PREFERRED EMBODIMENTS

Figure 1:
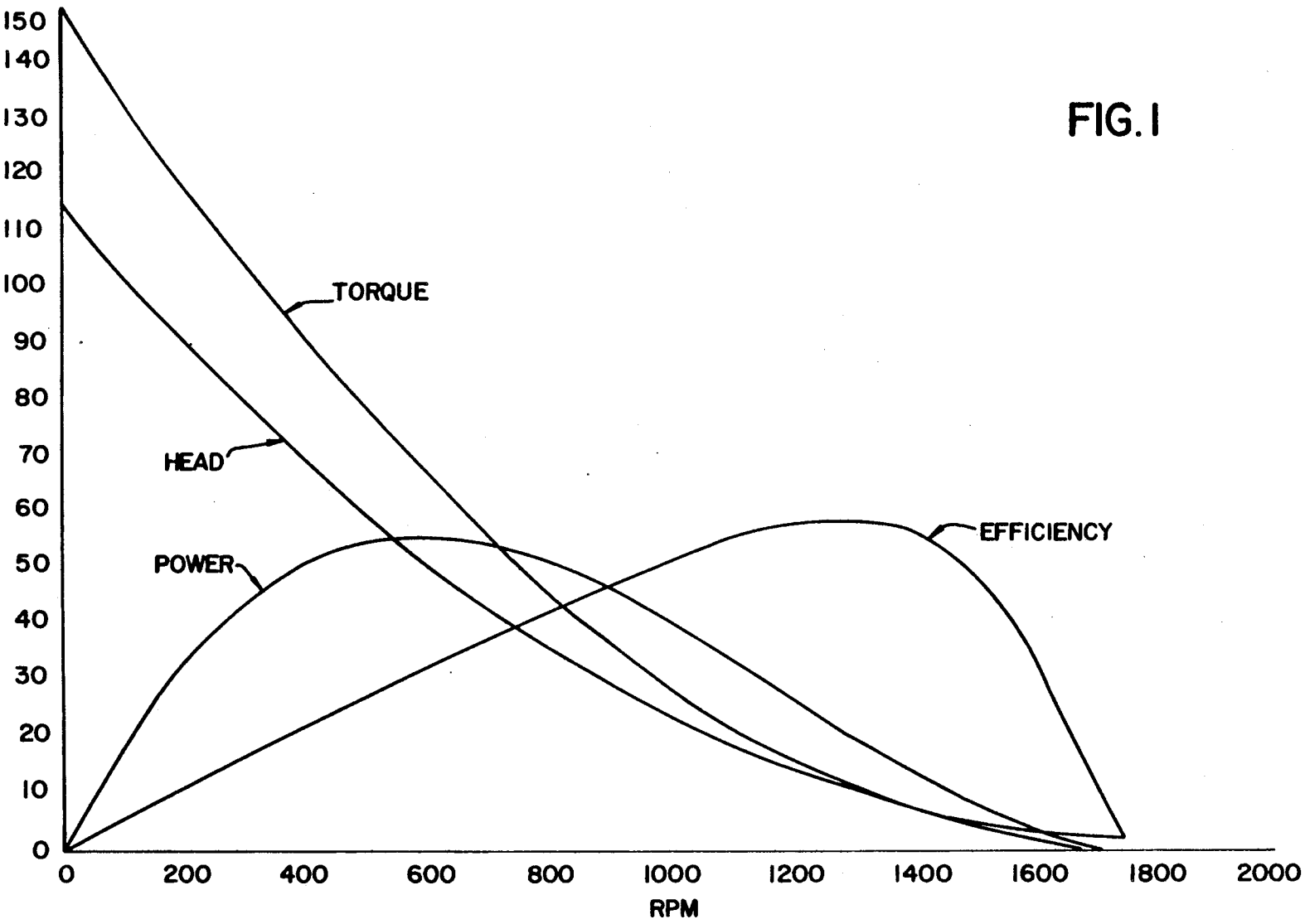
FIG. 1 is a graph showing turbine operating characteristics.
Figure 2A:
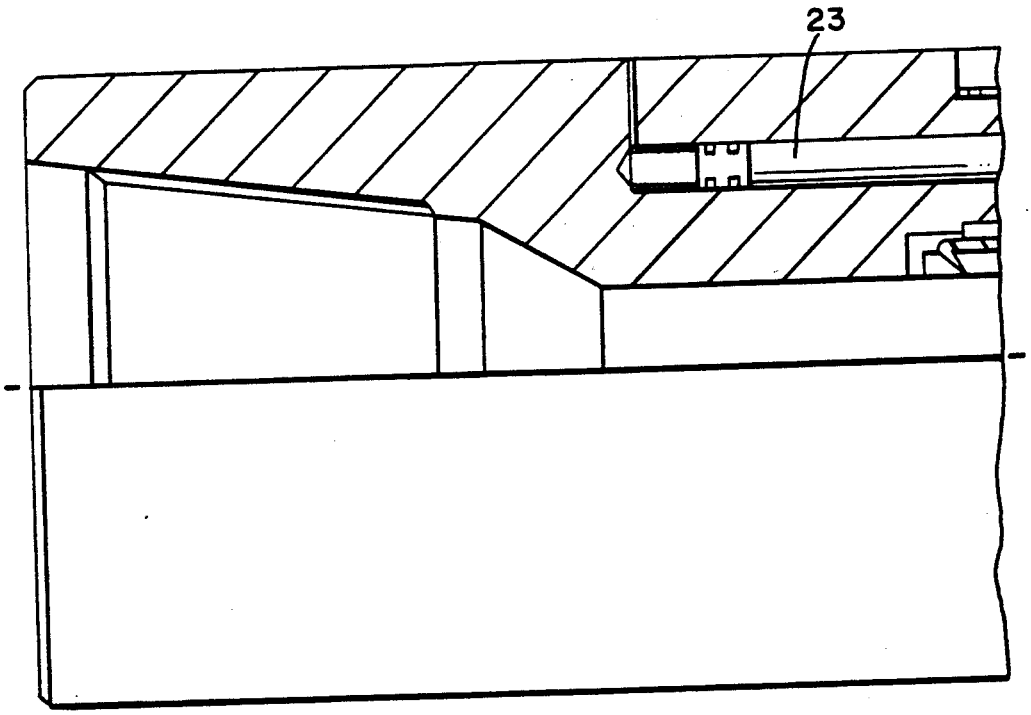
FIGS. 2A–2F are a sectional view of a downhole motor which includes a turbine of the present invention.
Figure 2B:
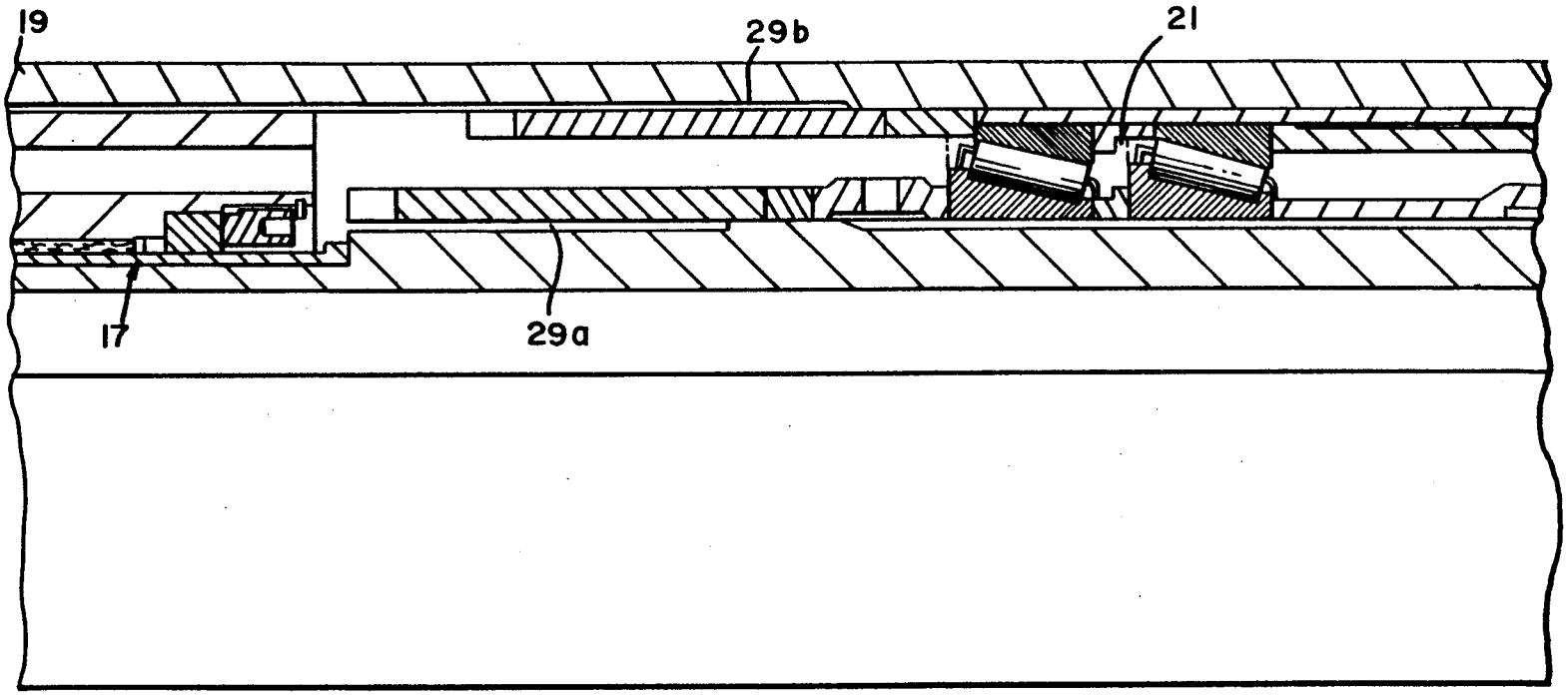
Figure 2C:
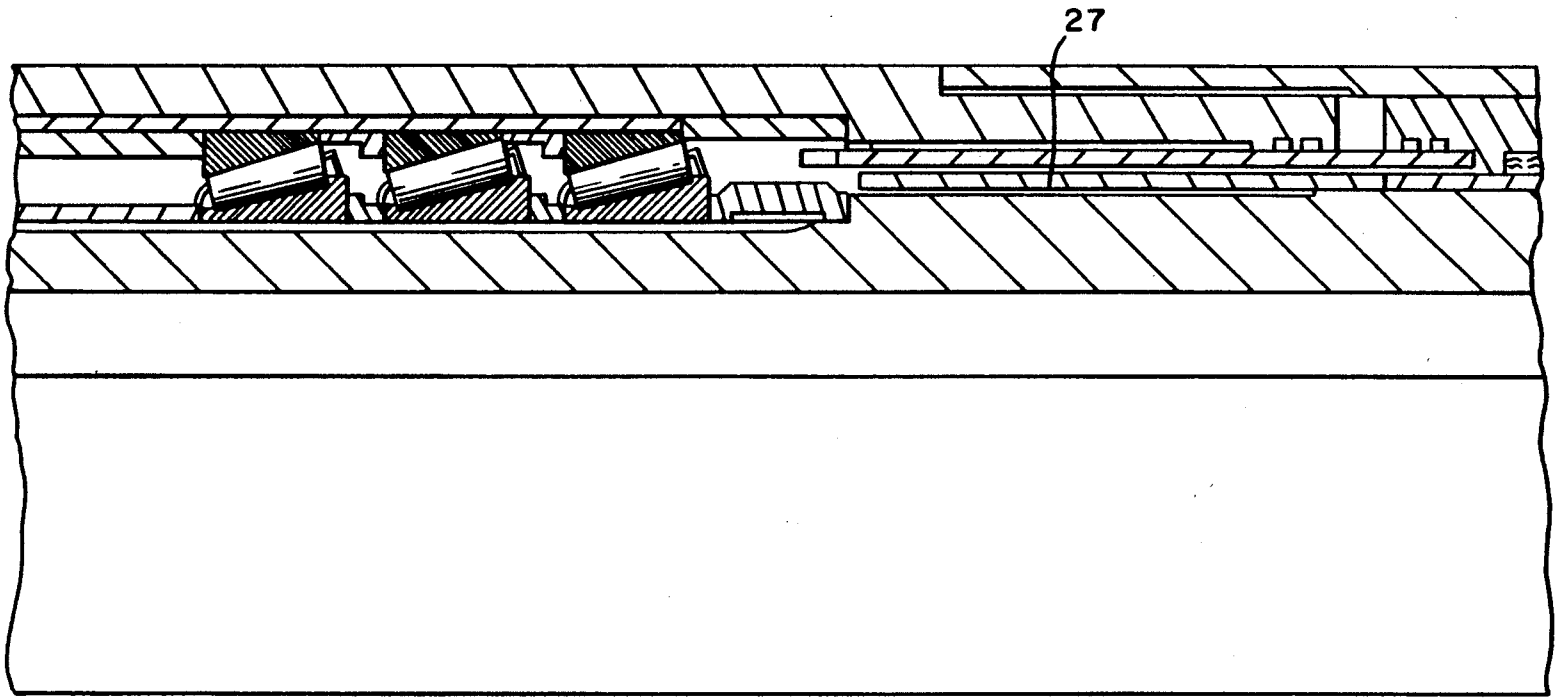
Figure 2D:
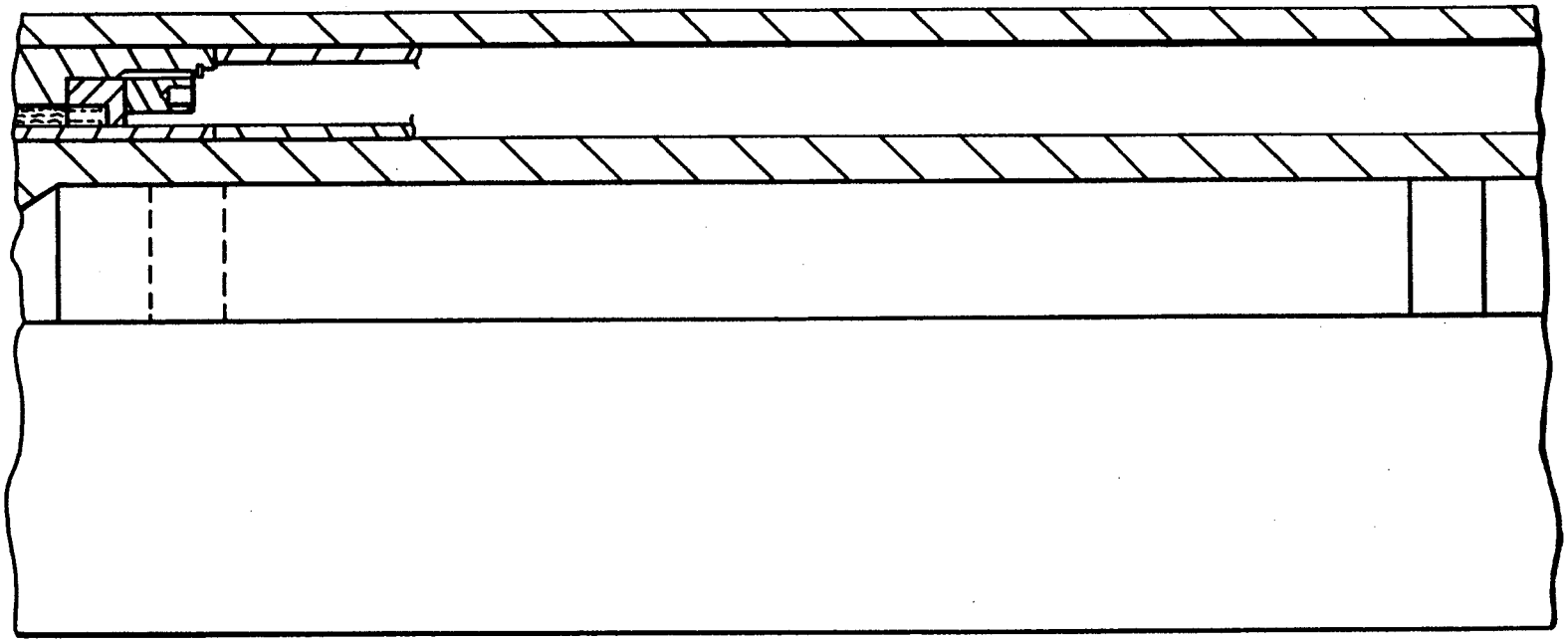
Figure 2E:
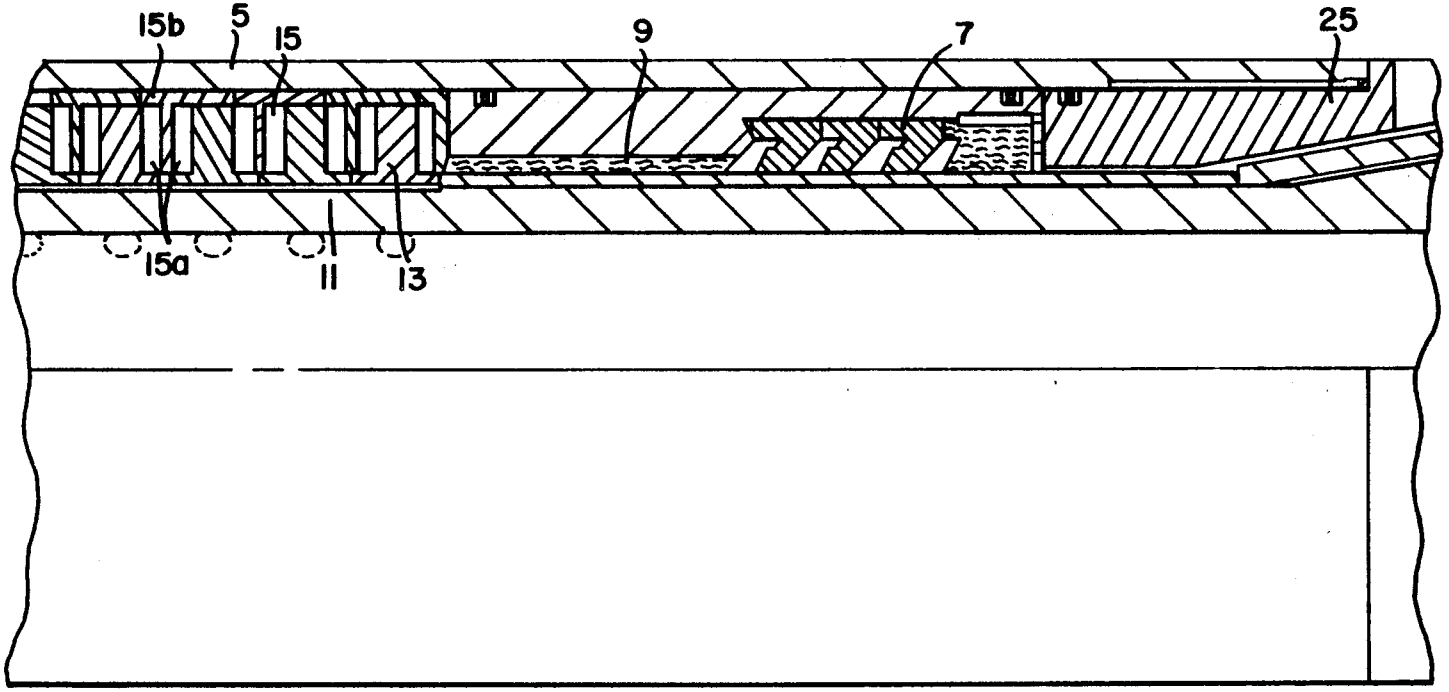
Figure 2F:
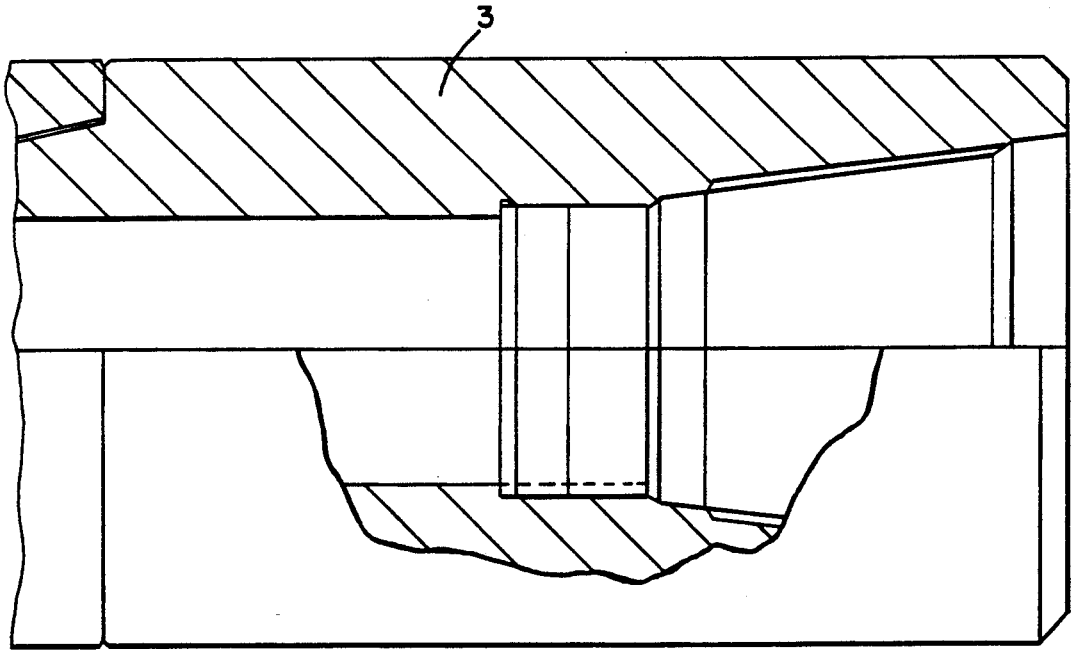

The present invention is directed to a multiple stage drag turbine which comprises a plurality of single stages, which may be grouped for parallel and series flow, each of which operates on the principle of the shear stress of fluid flowing in passages or channels in each turbine stage against the edges of the turbine blades. The shear stress produces drag forces on the blades. The volume of flow is not a direct factor, rather only the shear forces on the edges of the turbine blades. The power produced by the shear force is a function of the relative velocity of the fluid and the blade and drag surface, the drag surface being the edge of the turbine blades, and not the face surface of the blade itself. The use of the shear force results in a higher torque than a conventional turbine rotor of the same dimensions. This enables the motor of the present invention to generate sufficient torque using less stages which in turn enables it to be shorter in length than conventional turbine motors.

The shear stress utilized in the present invention is produced by the friction or scraping action on the edges of the blades. The shear stress or "drag force" is expressed as:

$$F_{dr}=\tau_{dr}a_{dr} \quad \ldots (1)$$

where:

$F_{dr}$=Drag (drive) force (N).

$\tau_{dr}$=Shear stress on the rotor blades (N/cm$^2$).

$a_{dr}$=Drag where the shear stresses acts ($m^2$).

The mechanical power produced by this drag force is expressed as:

$$HP=F_{dr}u=\tau_{dr}a_{dr}u/k \quad \ldots (2)$$

where:

u=Tangential velocity of the blades (m/s).

k=$10^4$ $m^2/cm^2$

Knowing that the hydraulic head in meters due to shear stresses is proportional to the square of the relative velocity between the fluid and the blades of the rotor, we have:

$$\tau_{dr}=\gamma\lambda_{dr}v^2/2\,gk \quad \ldots (3)$$

$\gamma$=Specific weight of the fluid ($N/m^3$).

$\lambda_{dr}$=Drag coefficient (dimensionless) of the rotor blades geometrical configuration.

v=Relative velocity of the fluid with respect to the edge of the blades of the turbine (m/s).

g=Gravity acceleration ($m/s^2$).

Simultaneously a hydraulic head is produced due to friction against the wall or walls of the passage not covered by blades.

$$\tau_{fr}=\gamma\lambda_{fr}v^2/2\,gk \quad \ldots (4)$$

$\tau_{fr}$=Shear stress in the stator ($N/cm^2$).

$\lambda_{fr}$=Friction coefficient (dimensionless) of the stator walls (without blades).

Substituting equation (3) into equation (2) and also substituting the value of the relative velocity v=(c-u), the mechanical power will be:

$$HP=\gamma\lambda_{drdr}u(c\text{-}u)^2/2\,g \quad \ldots (5)$$

c=Average velocity of the fluid through the channels of the turbine (m/s).

This is the fundamental equation of the turbine of the present invention. It can be seen that the output power does not depend on the angle of incidence of a mass or volume of a fluid, but rather, depends on other parameters, the specific weight of the fluid ($\gamma$), the dimensionless drag coefficient (drive coefficient) ($\lambda_{dr}$), the drag surface ($a_{dr}$), the velocity of the fluid (v) through the drag passage or channel of the turbine and the velocity of the rotor itself (u).

The input pressure and hydraulic power are calculated as follows:

The hydraulic head H is the specific energy which is used to circulate the fluid through the turbine and is calculated as follows:

$$H_{in}=[\tau_{dr}a_{dr}/\lambda A_m+\tau_{fr}a_{fr}/\lambda A_m]\kappa \quad \ldots (6)$$

$H_{in}$=Input pressure, input head or specific input energy (m).

$A_m$=Area of the section of the channels through which the fluid circulates with velocity c ($m^2$).

$a_{fr}$=Friction area where the shear stresses friction acts ($m^2$).

The first term of the right hand side of this equation is the head used by the rotor and the second term is the friction head lost in the stator without producing any power. Using the previous values in equations (3) and (4), the input head will be:

$$H_{in}=\lambda_{dr}a_{dr}(c-u)^2/2\,g\,A_m+\lambda_{fr}C^2/2\,g\,A_m \quad \ldots (7)$$

The input power in hydraulic terms is:

$$HP_{in}=\gamma H_{in}Q/K \ldots (w) \quad \ldots (8)$$

or $$HP_{in}=\frac{\gamma\,Q[\lambda_{dr}\,a_{dr}\,(c-u)^2+\lambda_{fr}\,a_{fr}\,C^2]}{2g\,A_m} \quad \ldots (9)$$

where:

$HP_{in}$=Input hydraulic power (w).

Q=Total volume of the fluid incoming into the turbine ($m^3/s$).

The efficiency is then:

$$\eta=HP/HP_{in} \quad \ldots (10)$$

substituting equations (5) and (9):

$$\eta=\frac{u/c}{1+\frac{\lambda_{fr}\,a_{fr}}{\lambda_{dr}\,a_{dr}}\left[\frac{1}{1-u/c}\right]^2} \quad \ldots (11)$$

It can thus be seen that the efficiency depends only on the through flow velocity, the rotor velocity and the physical and geometrical characteristics of the turbine, i.e., the drag surface, the friction surface and their corresponding dimensionless coefficients $\lambda$.

An example of the performance of the turbine, can be seen the graphs shown in FIG. 1.

FIGS. 2A–2F are a sectional view of a downhole motor of the present invention. Downhole motor 1 includes a hollow inner shaft 3 and an outer sleeve or housing 5, and has a seal structure 7 and bushing 9 at the input end. A turbine assembly 11 comprises a plurality of turbine stages which may be divided into a plurality of groups. Each stage comprises a stator assembly 13 and a rotor assembly 15. The stator assembly 13 includes a seal member **13*a* and a hub 13*b*, and the rotor assembly 15 includes a plurality of blades 15*a* and a rotor rim 15*b*. The bottom end of the turbine assembly is sealed by a second seal assembly 17 which includes a bushing 19. The top seal assembly 7 is a much heavier seal then the bottom seal assembly 17. The bushings 9 and 19 provide support and maintain alignment of the inner shaft 3 and outer sleeve 5. A roller bearing assembly 21 carries the thrust loads and radial loads and assists in maintaining the alignment between the inner shaft and outer sleeve. Although a roller bearing assembly is shown, other bearing assemblies such as ball bearings can also be used. The bearing structure also includes a self-contained lubricating system which may include a pressure compensator 23, if required. The turbine assembly and seals are loaded and held together by means of nuts 25 and 27, and the bearing assembly is held in place by nuts 29*a* and 29*b***.

Figure 3:
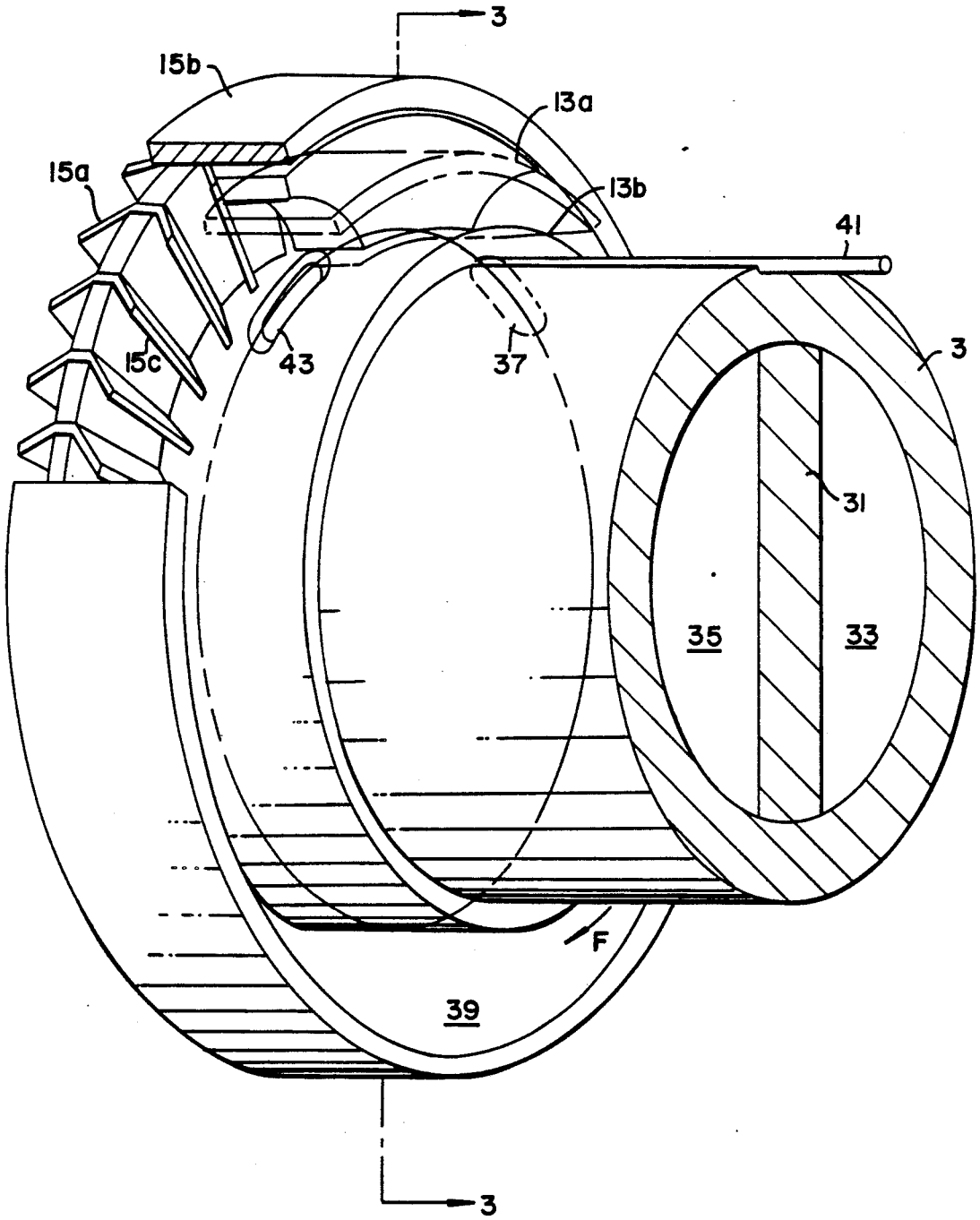
FIG. 3 is a perspective view of a turbine stage of the present invention.
Figure 4A:
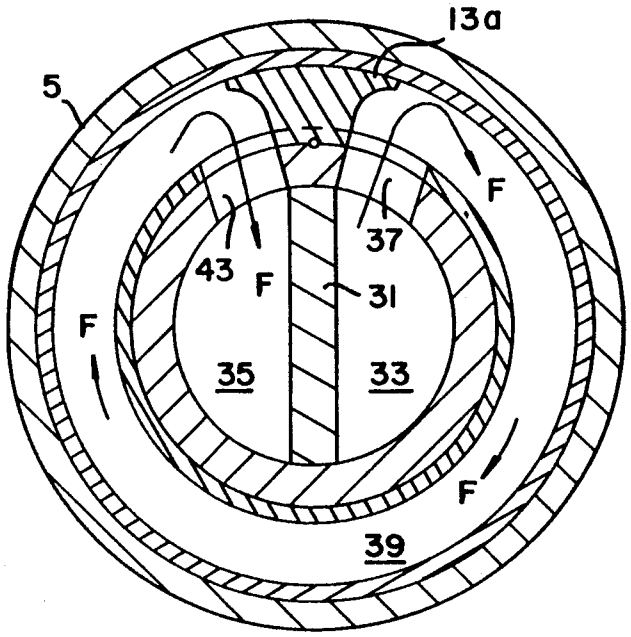
FIGS. 4A and 4B are cross-sectional views showing the path of fluid flow in a turbine stage of the present invention.
Figure 4B:
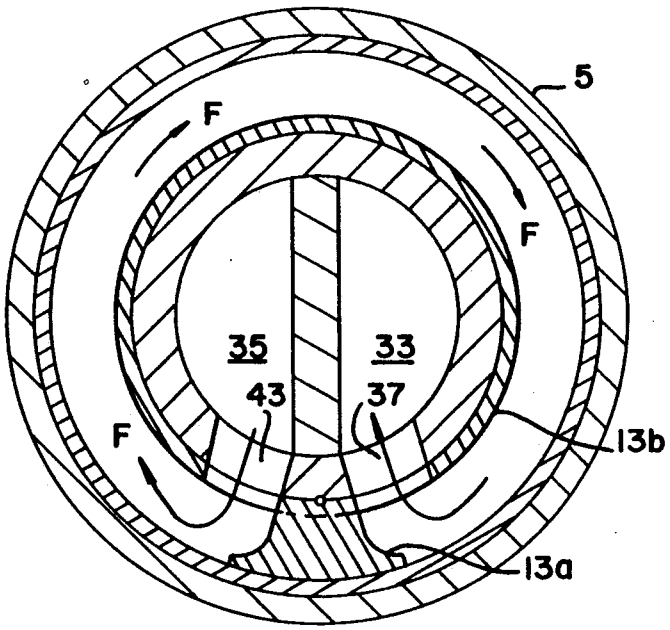

Referring to FIGS. 3 and 4A–4B, shaft 3 has an interior divider 31 which extends axially along the length of the shaft in the area surrounded by the turbine assembly. The purpose of the divider 31 is to divide the space in the inner shaft into two channels 33 and 35 for carrying fluid into the turbine assembly. Fluid F is pumped into the inner shaft from the top of the turbine motor assembly so that it flows down in channel 33. The fluid then goes through slotted opening 37 where it is then diverted into channel or passage 39 by seal member **13*a*** which is fixed onto hub member 13*b*. Hub member 13*b* is keyed onto inner shaft 3 by means of rod 41 so that stator member 13 does not rotate.

After channel 39 is filled and fluid flows around channel 39 and contacts the edges 15*c* of the blades 15*a* creating a shear, drag or edge force on the blade edges 15*c*. This drag force rotates the blade assembly or rotor 15. When the flow in channel 39 reaches seal member 13*a*, it is diverted through slotted opening 43 into channel 35 where it flows downward to the next group of stages. Rotation of the rotor 15 rotates the outer sleeve 5 which is fixed thereto by means of the loading of nuts 25 and 27. A drill bit (not shown) is coupled to the lower end of the downhole motor for rotation therewith.

Figure 5A:
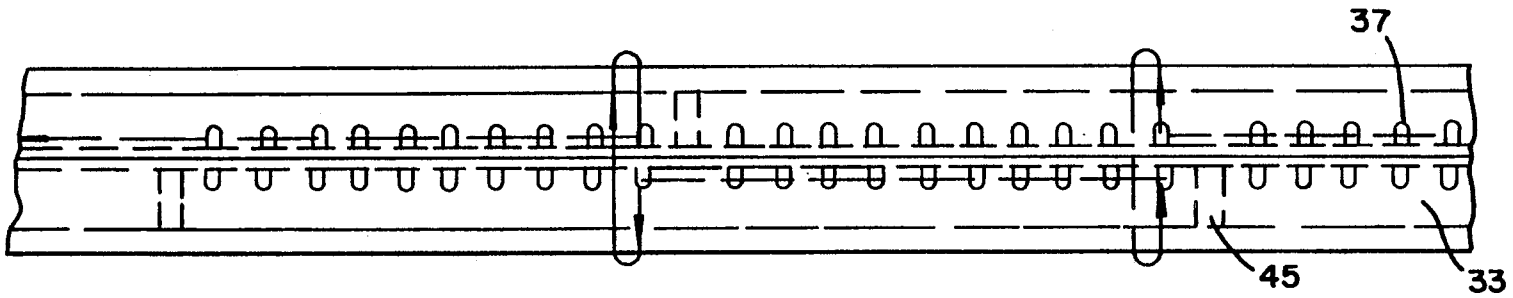
FIGS. 5A–5B illustrate the path of fluid flow through a plurality of stages of the turbine of the present invention.
Figure 5B:
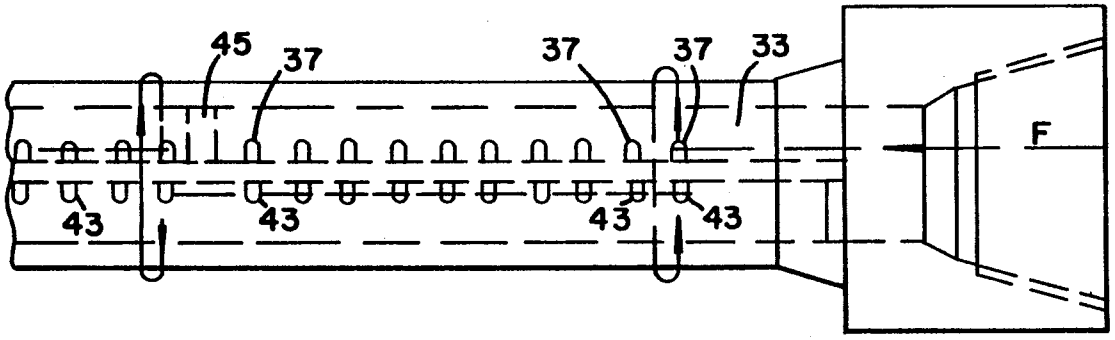

FIG. 5 illustrates the manner in which a plurality of turbine rotors or stages 15 are assembled in groups for parallel and serial operations. Fluid flows into one channel 33 in inner shaft 3, which in FIG. 5 is the upper half. Fluid comes out of the slot openings 37, flows around channels 39 and then re-enters the inner shaft through exit slot openings 37.

In the embodiment shown in FIG. 5, ten turbine stages form the first group. The flow through all ten stages is in parallel. Interior walls 45 are placed in channels 33 and 35 in the interior of shaft 3 to block flow through the channel and to cause the flow to go in parallel from the channel through the corresponding slot opening into the corresponding channel 39. The walls 45 are positioned to divide the turbine stages into groups. When the fluid flowing in channel 33 reaches a wall 45, the flow in channel 33 is blocked so that fluid flows into the group of ten turbine stages. After flowing through the turbine stages, the fluid flows into channel 35. Upon reaching an interior wall 45, the fluid is again blocked so it flows into the next group of turbine stages. In this next group, the slot openings 43 become the input slots. The input slot openings 43 in the second group of ten turbine stages are located in the bottom of the seal hub 13*b*, as shown in FIG. 3*b*. Thus even though the fluid is entering the turbine assembly from channel 35, it flows in the same direction as in the previous group of ten turbine stages. This alternating series and parallel flow continues through the entire turbine assembly.

The number of turbine stages included in each group and the number of groups will depend upon the particular conditions under which the downhole motor is used, primarily the required volume and pressure conditions necessary for drilling.

Figure 6:
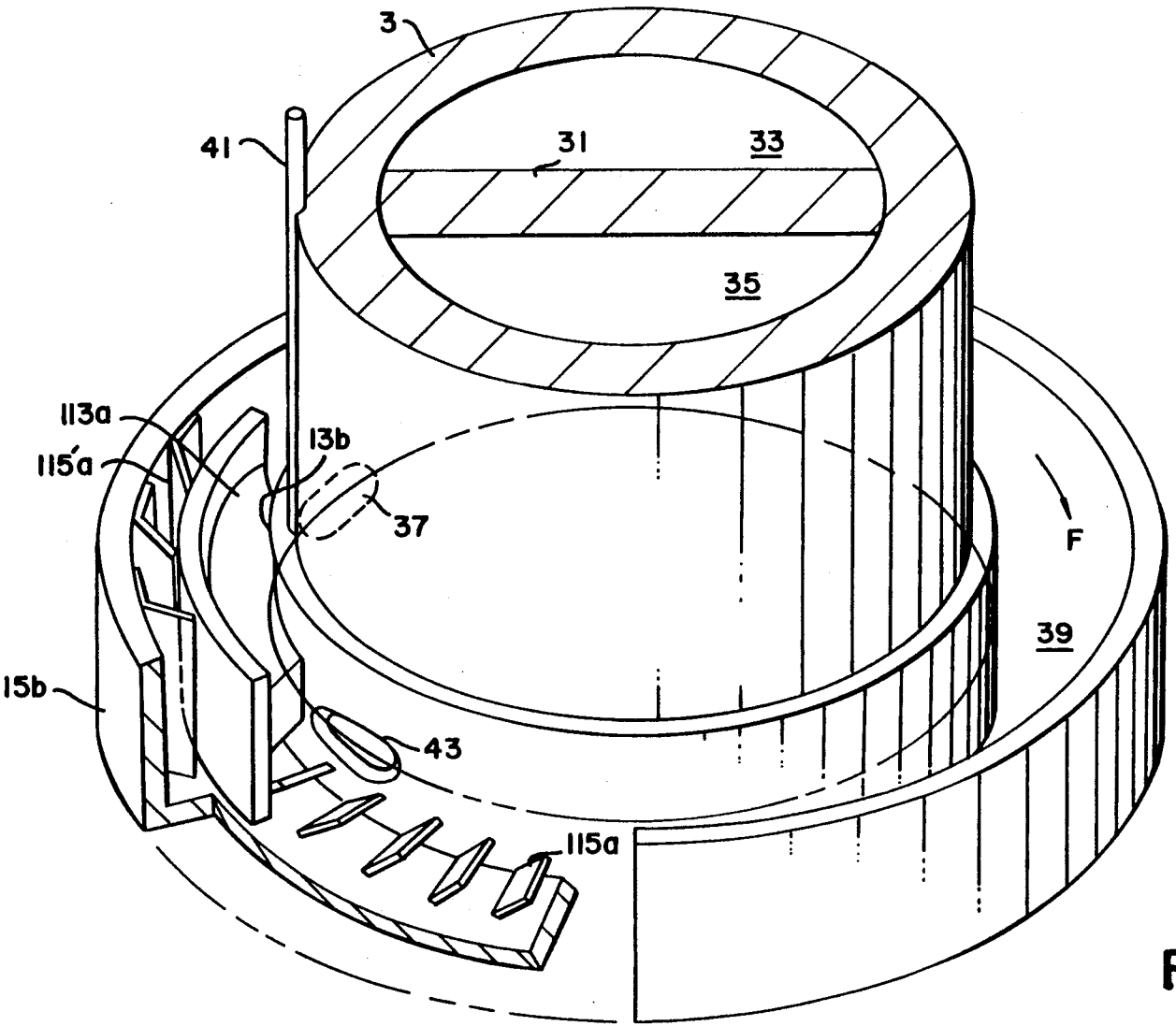
FIG. 6 is a perspective view of an alternative embodiment of a turbine stage of the present invention.

FIG. 6 shows an alternative embodiment of a stage of the turbine assembly. The difference between the embodiment of FIG. 2 and the embodiment of FIG. 6 is in the structure of the blades 115*a* and 115'*a*. Corresponding changes have also been made to the seal member 113*a*. In particular, in the embodiment of FIG. 3, the blades 15*a* are in the axial direction, whereas in the embodiment of FIG. 6, the blades 115*a* and 115'*a* are in the radial and axial direction.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A multistage drag turbine assembly for use in a downhole motor, said drag turbine assembly comprising:

(a) an outer sleeve;

(b) a central shaft positioned within said outer sleeve, said central shaft having a hollow center and a divider means extending longitudinally in said hollow center for forming first and second longitudinal channels therein;

(c) stator means mounted on said shaft, said stator means having a hub surrounding said shaft and a seal means fixed to said hub, wherein said hub and said shaft each have corresponding first and second slot openings therein;

(d) rotor means comprising a rotor rim and a plurality of turbine blades mounted on said rotor rim, said rotor means being positioned within said outer sleeve for rotation therewith with respect to said stator means such that a flow channel is formed in said outer sleeve between said turbine blades and said stator means; and (e) wherein a flow path is formed in said turbine assembly such that fluid flows through said turbine assembly flows through said first longitudinal channel in said central shaft, through said first slot openings in said shaft and said stator hub, through said flow channel wherein said fluid contacts the edges of said turbine blades for causing a drag force thereon, and through said second slot openings in said stator hub and said shaft into said second channel.

2. A multistage drag turbine assembly as set forth in claim 1, wherein said seal means is positioned between said first and second slot openings in said hub and wherein said seal means directs flow through said first slot opening into said flow channel and directs flow in said flow channel into said second slot opening.

3. A multistage drag turbine assembly as set forth in claim 1, including interior wall means positioned in said first and second channels for blocking flow in said channels such that the flow is through said first slot openings.

4. A multistage drag turbine assembly as set forth in claim 3, wherein said interior wall means are positioned in first and second channels for forming groups of drag turbine stages such that the flow through the stages in each of said groups is parallel and the flow through adjacent groups is in series.

5. A multistage drag turbine assembly as set forth in claim 1, wherein said turbine blades are fixed to said rotor rim in an axial direction with respect to said rotor rim.

6. A multistage drag turbine assembly as set forth in claim 1, wherein said turbine blades are fixed to said rotor rim in a radial direction with respect to said rotor rim.

7. A multistage drag turbine assembly as set forth in claim 1, wherein said turbine blades are external of said center shaft.

* * * * *